US007664335B2

(12) United States Patent
Kurumisawa et al.

(10) Patent No.: US 7,664,335 B2
(45) Date of Patent: Feb. 16, 2010

(54) AUTOMATIC IMAGE CORRECTION CIRCUIT

(75) Inventors: Takashi Kurumisawa, Shiojiri (JP); Masayuki Hayashi, Hino (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

(21) Appl. No.: 11/294,543

(22) Filed: Dec. 6, 2005

(65) Prior Publication Data

US 2006/0126083 A1 Jun. 15, 2006

(30) Foreign Application Priority Data

Dec. 9, 2004 (JP) ..... 2004-356417

(51) Int. Cl.
*G06K 15/02* (2006.01)

(52) U.S. Cl. ..... 382/254; 358/1.2; 358/1.9; 358/518

(58) Field of Classification Search ..... 382/254; 358/1.2, 1.9, 518
See application file for complete search history.

(56) References Cited

U.S. PATENT DOCUMENTS

| | | | | |
|---|---|---|---|---|
| 5,978,514 | A | 11/1999 | Yamaguchi et al. | |
| 6,937,370 | B1 * | 8/2005 | Nitta et al. | 358/518 |
| 7,428,021 | B2 * | 9/2008 | Fukuda | 348/650 |
| 7,508,543 | B2 * | 3/2009 | Mori | 358/1.9 |
| 2003/0030613 | A1 * | 2/2003 | Chae | 345/89 |
| 2003/0206242 | A1 * | 11/2003 | Choi | 348/441 |
| 2004/0109181 | A1 * | 6/2004 | Suzuki | 358/1.9 |
| 2004/0213457 | A1 * | 10/2004 | Mori | 382/167 |
| 2004/0218094 | A1 * | 11/2004 | Choi | 348/441 |

FOREIGN PATENT DOCUMENTS

| | | |
|---|---|---|
| JP | A-08-129356 | 5/1996 |
| JP | A-08-140088 | 5/1996 |
| JP | A 09-270915 | 10/1997 |
| JP | A 11-224336 | 8/1999 |
| JP | A-11-275348 | 10/1999 |
| JP | A-2000-165647 | 6/2000 |
| KR | 2001-0090261 | 10/2001 |
| KR | 2003-0070692 | 9/2003 |
| KR | 10-2004-0015965 | 2/2004 |

* cited by examiner

*Primary Examiner*—Bhavesh M Mehta
*Assistant Examiner*—Stephen R Koziol
(74) *Attorney, Agent, or Firm*—Oliff & Berridge, PLC

(57) ABSTRACT

An automatic image correction circuit is provided which automatically performs image correction on received image data and includes a resolution detection unit that detects resolutions of the image data; a set value calculation unit that calculates a set value to be used in the image correction based on the resolutions; and an image correction unit that performs the image correction on the image data based on the set value.

6 Claims, 14 Drawing Sheets

| HORIZONTAL RESOLUTION hsc [dot] | LENGTH sh OF SAMPLING AREA IN HORIZONTAL DIRECTION [dot] | VERTICAL RESOLUTION vsc [dot] | LENGTH vh OF SAMPLING AREA IN VERTICAL DIRECTION [dot] |
|---|---|---|---|
| — | — | — | — |
| — | — | 256 TO 511 | 256 |
| 512 TO 1023 | 512 | 512 TO 1023 | 512 |
| 1024 TO 1600 | 1024 | 1024 TO 1600 | 1024 |

FIG. 6

| SPECIFI-CATION | HORIZONTAL RESOLUTION hsc [dot] | VERTICAL RESOLUTION vsc [dot] | LENGTH sh OF SAMPLING AREA IN HORIZONTAL DIRECTION [dot] | LENGTH vh OF SAMPLING AREA IN VERTICAL DIRECTION [dot] | SAMPLING AREA RATIO |
|---|---|---|---|---|---|
| VGA | 640 | 480 | 512 | 256 | 0. 43 |
| SVGA | 800 | 600 | 512 | 512 | 0. 55 |
| XGA | 1024 | 768 | 1024 | 512 | 0. 67 |
| WXGA | 1280 | 768 | 1024 | 512 | 0. 53 |
| WXGA+ | 1366 | 768 | 1024 | 512 | 0. 50 |
| SXGA | 1280 | 1024 | 512 | 1024 | 0. 80 |
| SXGA+ | 1400 | 1050 | 512 | 1024 | 0. 71 |
| UXGA | 1600 | 1200 | 512 | 1024 | 0. 55 |

FIG. 10

| SPECIFI-CATION | HORIZONTAL RESOLUTION hsc [dot] | VERTICAL RESOLUTION vsc [dot] | APERTURE RATIO [%] | LIGHTNESS CORRECTION INTENSITY (COEFFICIENT) |
|---|---|---|---|---|
| VGA | 640 | 480 | 95 | 0. 8 |
| SVGA | 800 | 600 | 90 | 0. 83 |
| XGA | 1024 | 768 | 80 | 0. 90 |
| WXGA | 1280 | 768 | 75 | 1. 0 |
| WXGA+ | 1366 | 768 | 75 | 1. 0 |
| SXGA | 1280 | 1024 | 70 | 1. 2 |
| SXGA+ | 1400 | 1050 | 70 | 1. 2 |
| UXGA | 1600 | 1200 | 60 | 1. 5 |

AUTOMATIC IMAGE CORRECTION CIRCUIT

The present application claims priority to Japanese Patent Application No. 2004-356417 filed Dec. 9, 2004, which is hereby expressly incorporated by reference herein in its entirety.

BACKGROUND

1. Technical Field

The present invention relates to an automatic image correction circuit that automatically performs image correction by detecting resolutions of input image data.

2. Related Art

An automatic image correction circuit that automatically performs image correction on input image data has been known. The automatic image correction circuit is a circuit that calculates statistic values of received image data, such as luminance and chroma, and performs image correction suitable for images, which are being received, based on the statistic values. The automatic image correction circuit enhances images to be displayed through image correction, such as level correction, gamma correction, or contrast correction.

The automatic image correction circuit sometimes performs image data correction by calculating statistic values using resolutions of image data or by changing a set value. In a general automatic image correction circuit, a user inputs resolutions of image data to a register, etc. in advance and the automatic image correction circuit then performs image correction on image data based on the resolutions input in advance. However, the method in which a user inputs resolutions every image data is not preferred in terms of user-friendly aspect and accuracy. Furthermore, this method cannot cope with a case where resolutions of input image data are dynamically changed.

SUMMARY

An advantage of some aspects of the invention is that it provides an automatic image correction circuit that detects resolutions of input image data and automatically performs image correction appropriate for the detected resolutions.

According to an aspect of the invention, an automatic image correction circuit is an automatic image correction circuit that automatically performs image correction on received image data. The circuit includes a resolution detection unit that detects resolutions of the image data, a set value calculation unit that calculates a set value to be used in the image correction based on the resolutions, and an image correction unit that performs the image correction on the image data based on the set value.

The automatic image correction circuit is a circuit that receives image data, such as still images or moving images, and automatically performs image correction on these image data. The automatic image correction circuit includes the resolution detection unit that detects resolutions of the received image data, i.e., a horizontal resolution and a vertical resolution. The resolution detection unit can detect resolutions from a clock signal and a data enable signal of the image data. Furthermore, the automatic image correction circuit includes the set value calculation unit. The set value calculation unit can calculate a set value, which is used to perform image correction, from the resolutions detected by the resolution detection unit. The image correction unit performs correction on image data with respect to, e.g., luminance based on the calculated set value. Therefore, a variety of settings, which are needed every resolution in the related art, can be automatically performed.

In the automatic image correction circuit according to the aspect of the invention, preferably, the set value calculation unit calculates a set value of a position of a sampling area, which is a part or the entire of the image data. Therefore, positional information of a region from which statistic values used to perform image correction will be calculated (hereinafter simply referred to as a "sampling area") can be automatically calculated according to resolutions obtained by the resolution detection unit.

In the automatic image correction circuit according to the aspect of the invention, preferably, the set value calculation unit calculates the position of the sampling area, which is a part or the entire of the image data, on the basis of a horizontal resolution and a vertical resolution so that the sampling area is located at a central region of an image. A viewer generally sees a central region of an image. Therefore, if image data sampled from the central region are used for image correction, it is possible to perform effective image correction.

As a preferred example, the set value calculation unit sets the range of the sampling area, which is a part or the entire of the image data, to on value of the powers of 2. Therefore, it is possible to detect only bits set, and to reduce the size of the circuit.

In the automatic image correction circuit according to the aspect of the invention, preferably, the set value calculation unit calculates a lightness correction coefficient based on a horizontal resolution and a vertical resolution of the image data in a set value for correcting a brightness of the image data. Therefore, image data can be automatically set to an appropriate brightness every resolution.

In the automatic image correction circuit according to the aspect of the invention, preferably, the automatic image correction circuit further includes a storage unit that stores the resolution of a display panel, a resolution comparison unit that compares the resolution of the display panel and the resolutions of the image data, an image magnification process unit that magnifies the image data, and an image reduction process unit that reduces the image data. Further, the image correction unit performs image correction on image data that are obtained by reducing the image data by the image reduction process unit when the resolution of the display panel is smaller than the resolutions of the image data, and performs image correction on image data that are enlarged by the image magnification process unit when the resolution of the display panel is larger than the resolutions of the image data. The automatic image correction circuit further includes the resolution comparison unit. The resolution comparison unit stores the resolution of a display panel in advance and compares the resolution of the display panel with detected resolutions of image data. If the resolutions of the image data are greater than the resolution of the display panel, the image reduction process unit performs a reduction process on image data after a correction process is carried out. Meanwhile, if the resolutions of the image data are smaller than the resolution of the display panel, the image magnification process unit performs a magnification process on image data before a correction process is performed. Therefore, the three kinds of processes, such as the magnification process, the reduction process and the correction process, can be automatically performed on image data according to resolutions.

BRIEF DESCRIPTION OF THE DRAWINGS

The invention will be described with reference to the accompanying drawings, wherein like numbers reference like elements.

FIG. 6 is a table showing resolutions, the sizes of sampling areas and sampling ratios.

FIG. 10 is a table showing the relation between resolutions and lightness correction coefficients.

DESCRIPTION OF EXEMPLARY EMBODIMENTS

The invention will now be described in detail in connection with preferred embodiments with reference to the accompanying drawings.

First Embodiment

Figure 1:
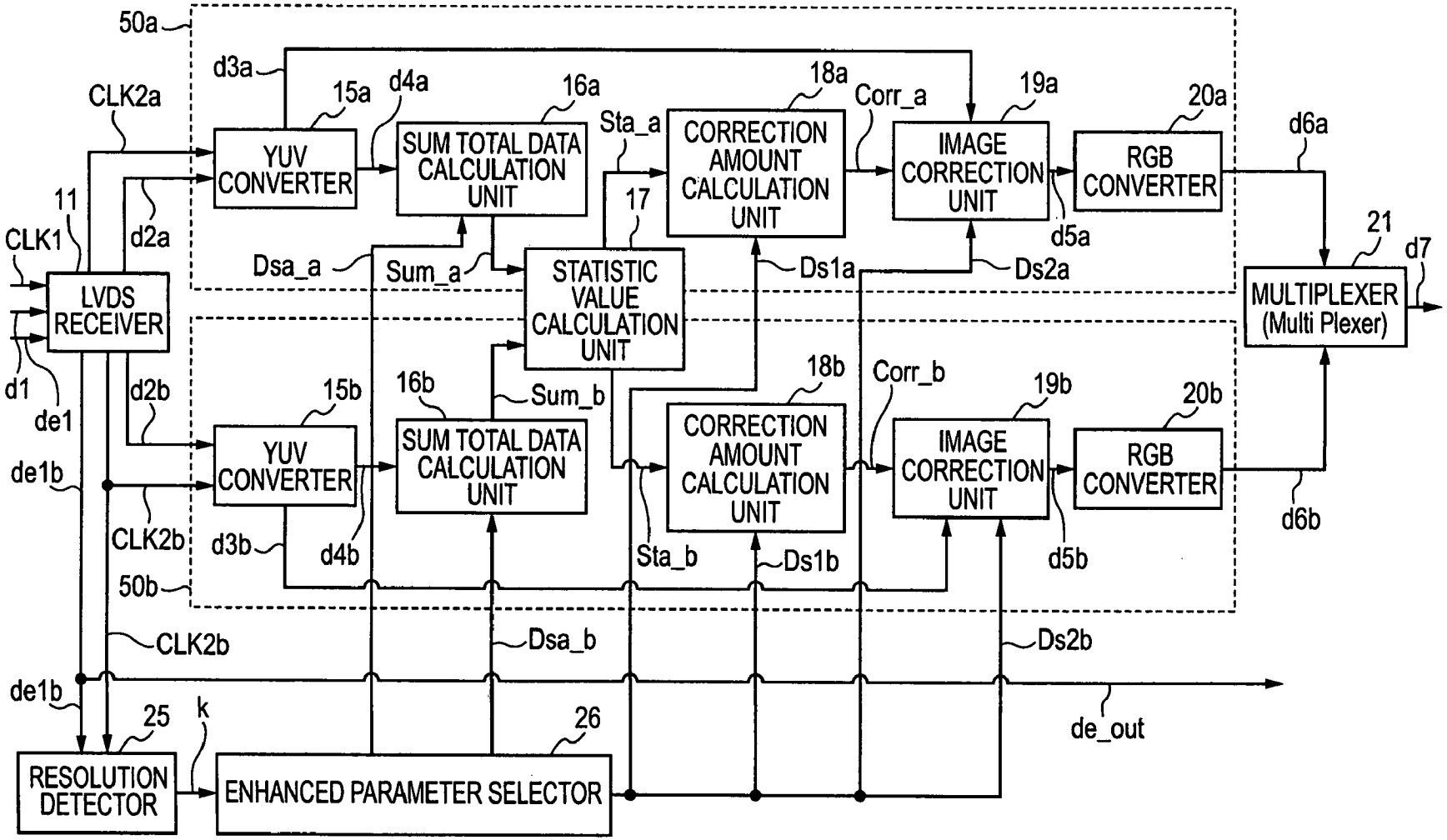
FIG. 1 schematically shows the construction of an automatic image correction circuit according to a first embodiment of the invention.

An automatic image correction circuit 100 according to a first embodiment of the invention will be described with reference to FIG. 1. FIG. 1 is a block diagram schematically showing the construction of the automatic image correction circuit 100 according to a first embodiment of the invention.

Construction of Automatic Image Correction Circuit

The automatic image correction circuit 100 mainly includes a Low Voltage Differential Signal (LVDS) receiver 11, a resolution detector 25, an enhanced parameter selector 26, statistic value calculation unit 17, image correction blocks 50*a* and 50*b*, and a multiplexer 21.

The automatic image correction circuit 100 is a circuit that receives image data of still images or moving images, and automatically performs image correction on these image data on a frame basis. The automatic image correction circuit 100 mainly performs an image correction process for enhancing images to be displayed. Furthermore, the automatic image correction circuit 100 can be mounted in an electronic apparatus, etc., which has an image display unit. For example, in a portable telephone or a portable terminal having a liquid crystal panel, etc. as an image display unit, the automatic image correction circuit 100 can be installed within an image processor that supplies display image data to the image display unit or the driver of the liquid crystal panel.

The LVDS receiver 11 receives image data d1 that must be processed by the automatic image correction circuit 100, a clock signal CLK1 serving as a reference upon processing within the automatic image correction circuit 100, and a data enable signal de1 indicating the valid period of the image data d1 from the outside. The LVDS receiver 11 outputs data whose voltage is controlled as a small swing because EMI (Electroluminance Interference) is generated within the circuit if the image data d1 are output as a full swing voltage when the image data d1 are input at high speed. Furthermore, the received image data d1 are data of RGB form, e.g., data of 24 bits/pixels.

The LVDS receiver 11 divides the received image data d1 into image data d2*a* and image data d2*b*, and supplies those data to the image correction block 50*a* and the image correction block 50*b*, respectively. The LVDS receiver 11 also supplies a clock signal CLK2*a* and a clock signal CLK2*b* to the image correction blocks 50*a* and 50*b*, respectively.

The LVDS receiver 11 also supplies the clock signal CLK2*b* that has been supplied to the image correction block 50*b* and a data enable signal de1*b*, which indicates the valid period of the image data d2*b*, to the resolution detector 25. The data enable signal de1*b* is also supplied to the image display unit as a data enable signal de_out. In this case, the LVDS receiver 11 can also supply the clock signal CLK2*a* and the image data d2*a*, which have been supplied to the image correction block 50*a*, and a data enable signal of the image data d2*a* (not shown).

Furthermore, the LVDS receiver 11 can receive image data that have been divided into two groups from two systems. At this time, the LVDS receiver 11 can supply the image data d2*a* and d2*b* to the image correction blocks 50*a* and 50*b*, respectively, without dividing them. In addition, the automatic image correction circuit 100 is not limited to the construction in which the image data d1 are received by a single LVDS receiver 11, but may have a construction in which image data divided into plural groups are received by a plurality of LVDS receivers.

The resolution detector 25 detects a horizontal resolution and a vertical resolution of the image data d2*b* from the clock signal CLK2*b* and the data enable signal de1*b*, which are received from the LVDS receiver 11. The resolution detector 25 supplies the horizontal resolution and the vertical resolution of the image data d2*b* to the enhanced parameter selector 26 as resolution data k. Furthermore, the method of detecting a horizontal resolution and a vertical resolution in the resolution detector 25 will be described in detail below.

The enhanced parameter selector 26 generates a set value for image correction in the automatic image correction circuit 100 based on the resolution data k (i.e., the horizontal resolution and the vertical resolution of the image data d2*b*), which are received from the resolution detector 25. For example, the enhanced parameter selector 26 can calculate positional information of a region from which statistic values, which are used to perform image correction by the image correction blocks 50*a* and 50*b*, will be calculated (hereinafter simply referred to as a "sampling area"), from the horizontal resolution and the vertical resolution of the image data d2*b*. The sampling area is set to a position serving as a central region of an image. The calculated positional information of the sampling area is supplied as sampling area data Dsa_a and Dsa_b from the enhanced parameter selector 26 to the sum total data calculation units 16*a* and 16*b*. The enhanced parameter selector 26 can automatically perform a variety of settings, which were needed every resolution.

In another example of data generation of the enhanced parameter selector 26, a set value for correcting brightness is generated using the horizontal resolution and the vertical resolution of the image data d2*b*. The higher the resolution of an image, the smaller one pixel. It is, however, difficult to miniaturize a TFT element or a circuit for driving pixels accordingly in view of its electrical characteristics. Due to this, the aperture ratio of one pixel is lowered that much. It is therefore necessary to supplement lowered brightness according to a lowered aperture ratio by raising brightness as much as the aperture ratio is lowered. The enhanced parameter selector 26 calculates a coefficient for correcting such brightness (hereinafter simply referred to as a "lightness correction coefficient"), and supplies the generated lightness correction coefficient to correction amount calculation units 19*a* and 19*b* as set values Ds2*a* and Ds2*b*. Furthermore, the method of generating data in the enhanced parameter selector 26 will be described in detail below.

The automatic image correction circuit 100 performs an image correction process on the two image data groups d2*a* and d2*b* through the two blocks: the image correction block 50*a* and the image correction block 50*b*, respectively. That is, the automatic image correction circuit 100 performs an image correction process on the received image data d1 using a plurality of blocks. In particular, the image correction block 50*a* and the image correction block 50*b* calculate a gray level value histogram, a luminance sum total and a chroma sum total (i.e., "sum total data") with respect to each of the input image data d2*a* and d2*b* and supply the sum total data to the statistic value calculation unit 17. The statistic value calculation unit 17 calculates statistic values of the image data from the sum total data and supplies the calculated statistic value to the image correction blocks 50*a* and 50*b*, respectively. In addition, the image correction blocks 50*a* and 50*b* find a correction amount based on the statistic value received from the statistic value calculation unit 17 and perform an image correction process on the image data using the correction amount. Image data d6*a* and d6*b*, which have experienced the image correction process through the image correction block 50*a* and the image correction block 50*b*, are supplied to the multiplexer 21.

The multiplexer 21 generates image data d7 by combining two image data d6*a* and d6*b* into one, and outputs the generated image data d7 to an image display unit (not shown) such as a Liquid Crystal Display (LCD) panel. The image display unit (not shown) displays the image data d7 received from the multiplexer 21.

Furthermore, the automatic image correction circuit 100 can output the two image data d6*a* and d6*b* to the image display unit without combining them. In this case, the automatic image correction circuit 100 may not include the multiplexer 21, and the image data d6*a* and d6*b* respectively output from the image correction blocks 50*a* and 50*b* are supplied to the image display unit without change.

An image process that is executed in the image correction blocks 50*a* and 50*b* and the statistic value calculation unit 17 will be described in detail below.

The image correction block 50*a* includes a YUV converter 15*a*, a sum total data calculation unit 16*a*, a correction amount calculation unit 18*a*, an image correction unit 19*a*, and a RGB converter 20*a*. In the same manner, the image correction block 50*b* includes a YUV converter 15*b*, a sum total data calculation unit 16*b*, a correction amount calculation unit 18*b*, an image correction unit 19*b*, and a RGB converter 20*b*.

The image data d2*a* and the clock signal CLK2*a* are input to the YUV converter 15*a*. The input image data d2*b* and the clock signal CLK2*b* are input to the YUV converter 15*b*. The YUV converters 15*a* and 15*b* convert the RGB type image data d2*a* and d2*b* into YUV type image data (YUV conversion). The YUV converters 15*a* and 15*b* supply YUV-converted image data d3*a* and d3*b*, which are obtained by the YUV conversion, to the image correction units 19*a* and 19*b*, respectively, and also supply YUV converted image data d4*a* and d4*b* to the sum total data calculation units 16*a* and 16*b*, respectively.

The sum total data calculation units 16*a* and 16*b* calculate sum total data for the received image data d4*a* and d4*b*. In particular, the sum total data calculation units 16*a* and 16*b* calculate a sampling area, i.e., a central region of an image from the image data d4*a* and d4*b* by using the sampling area data Dsa_a and Dsa_b that are received from the enhanced parameter selector 26. The sum total data calculation units 16*a* and 16*b* calculate a luminance sum total and a chroma sum total while generating a gray level value histogram from the data of the sampling area of the image data d4*a* and d4*b*. The reason why only a central region of an image not the whole image is used, as described above, is that as a viewer usually sees a central region of an image, it is effective to perform an image correction process based on image data of the central region. Sum total data Sum_a and Sum_b calculated as described above are output to the statistic value calculation unit 17.

The statistic value calculation unit 17 calculates statistic values Sta_a and Sta_b with respect to luminance and chroma of the image data d4*a* and d4*b* on the basis of the received sum total data Sum_a and Sum_b. In particular, the statistic value calculation unit 17 calculates statistic values, such as the highest value and the lowest value of luminance, the mean values of luminance and chroma, and standard deviation of luminance.

The statistic values Sta_a and Sta_b calculated as described above are supplied to the correction amount calculation units 18*a* and 18*b*. The correction amount calculation units 18*a* and 18*b* calculate the intensity of correction for image data (i.e., a correction amount) based on the received statistic values Sta_a and Sta_b, and set values Ds1*a* and Ds1*b*, which are received from the enhanced parameter selector 26. In particular, the correction amount calculation units 18*a* and 18*b* calculate a level correction coefficient, a gamma correction amount, a contrast correction amount, and a chroma correction amount. Signals Corr_a and Corr_b corresponding to the calculated correction amounts are output to the image correction units 19*a* and 19*b*. Furthermore, the correction amount calculation units 18*a* and 18*b* perform scene detection on image data, while calculating the correction amount.

The image correction units 19*a* and 19*b* are supplied with the set values Ds2*a* and Ds2*b* from the enhanced parameter selector 26, the correction amounts Corr_a and Corr_b from the correction amount calculation units 18*a* and 18*b*, and the YUV-converted image data d3*a* and d3*b* from the YUV converters 15*a* and 15*b*. The image correction units 19*a* and 19*b* perform an image correction process on the image data d3*a* and d3*b* on the basis of the correction amounts Corr_a and Corr_b and the set values Ds2*a* and Ds2*b*. In particular, the image correction units 19*a* and 19*b* perform correction processes, such as level correction, gamma correction, contrast correction, and chroma correction, on the image data d3*a* and d3*b*. Image data d5*a* and d5*b*, which have experienced the image correction process, are output to the RGB converters 20*a* and 20*b*.

The RGB converters 20*a* and 20*b* convert the received image data d5*a* and d5*b* of YUV form into data of RGB form (i.e., "RGB conversion"). The RGB converters 20*a* and 20*b* supply the RGB-converted image data d6*a* and d6*b* to the multiplexer 21. The multiplexer 21 outputs the image data d7 that is obtained by combining the two image data d6*a* and d6*b* into one.

As described above, the automatic image correction circuit 100 according to the first embodiment includes the resolution detector 25 and the enhanced parameter selector 26. The resolution detector 25 can detect resolutions of received image data, and the enhanced parameter selector 26 can automatically calculate set values, such as a sampling area and a lightness correction coefficient, based on the detected resolutions. As a result, the automatic image correction circuit 100 can automatically perform a variety of settings, which were needed on a resolution basis in the related art, and can perform an image correction process appropriate for respective image data.

Method of Detecting Horizontal Resolution and Vertical Resolution

A method of detecting a horizontal resolution and a vertical resolution, which is performed in the resolution detector 25, will be described below with reference to FIGS. 2 and 3.

Figure 2:
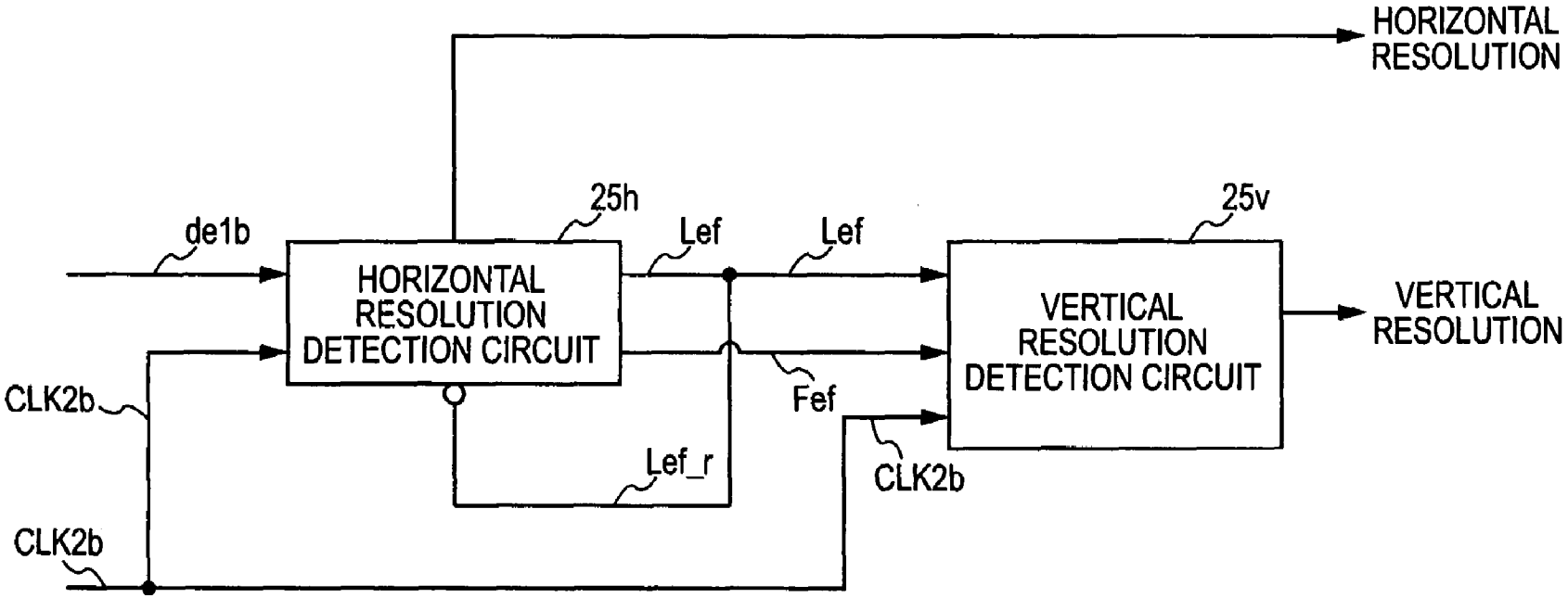
FIG. 2 is a view for illustrating a method of detecting resolutions.

FIG. 2 schematically shows the construction of the resolution detector 25 according to a first embodiment. The resolution detector 25 includes a horizontal resolution detection circuit 25*h* and a vertical resolution detection circuit 25*v*. The data enable signal de1*b* and the clock signal CLK2*b*, which are received from the LVDS receiver 11, are first input to the horizontal resolution detection circuit 25*h*. The horizontal resolution detection circuit 25*h* calculates a line end flag Lef using the clock signal CLK2*b* and a horizontal counter from the data enable signal de1*b*. At this time, a horizontal resolution can be detected from a value of the horizontal counter. The line end flag Lef output from the horizontal resolution detection circuit 25*h* resets the counter of the horizontal resolution detection circuit 25*h* as a reset signal Lef_r and is simultaneously supplied to the vertical resolution detection circuit 25*v*. The horizontal resolution detection circuit 25*h* also calculates a frame end flag Fef and supplies the flag signal to the vertical resolution detection circuit 25*v*. The vertical resolution detection circuit 25*v* receives the line end flag Lef and the frame end flag Fef from the horizontal resolution detection circuit 25*h*, and also receives the clock signal CLK2*b* from the LVDS receiver 11. The vertical resolution detection circuit 25*v* detects a vertical resolution on the basis of these signals.

The signals, which are input to and output from the horizontal resolution detection circuit 25*h* and the vertical resolution detection circuit 25*v*, will be described in more detail with reference to the timing chart shown in FIG. 3.

Figure 3:
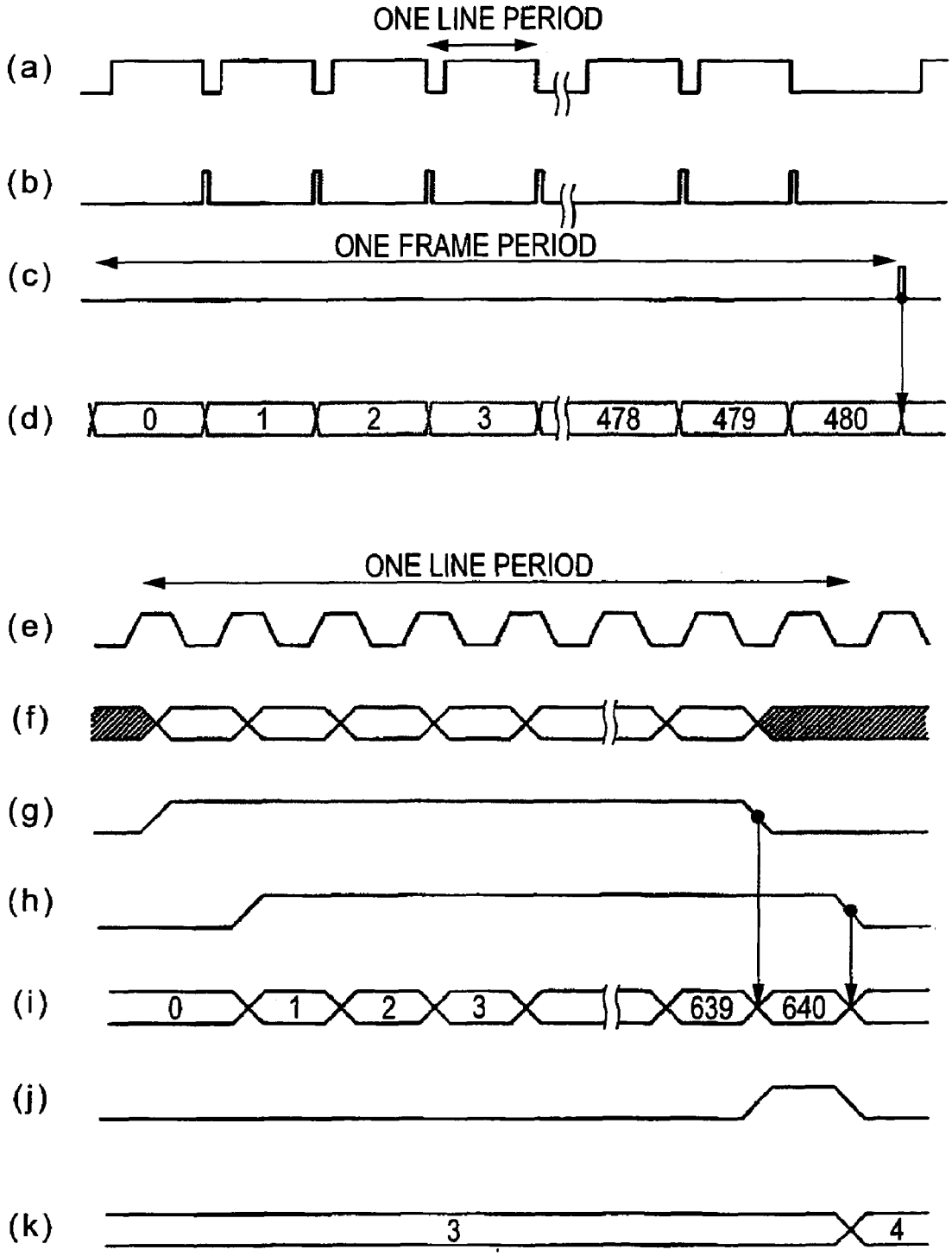
FIG. 3 is a timing chart of clock signals and data enable signals, which are input to a resolution detector.

FIG. 3 shows input and output signals in the resolution detection circuit 25 when detecting a horizontal resolution and a vertical resolution. (a) of FIG. 3 shows the data enable signal de1*b* input to the horizontal resolution detection circuit 25*h*. (b) of FIG. 3 shows the line end flag Lef. (c) of FIG. 3 shows the frame end flag Fef. (d) of FIG. 3 shows the vertical counter. FIGS. 3(*e*) to 3(*g*) show enlarged signals in one line period. (e) of FIG. 3 shows the clock signal CLK2*b* input to the horizontal resolution detection circuit 25*h* and the vertical resolution detection circuit 25*v*. (f) of FIG. 3 shows the image data d2*b*. (g) of FIG. 3 shows an enlarged signal of the data enable signal of (a) of FIG. 3 per one line period and also the valid period of the image data d2*b* shown in (f) of FIG. 3. (h) of FIG. 3 shows that the data enable signal of (g) of FIG. 3 is shifted by one counter. (i) of FIG. 3 shows the horizontal counter. (j) of FIG. 3 shows an enlarged signal of the line end flag Lef of (b) of FIG. 3 per one line period. (k) of FIG. 3 shows an enlarge signal of the vertical counter of (d) of FIG. 3 per one line period.

The horizontal resolution detection circuit 25*h* counts one line period from the rise to the fall of the data enable signal of (g) of FIG. 3 by using the horizontal counter of (i) of FIG. 3, according to the clock signal CLK2*b* of (e) of FIG. 3, and then generates the line end flag. In particular, the horizontal resolution detection circuit 25*h* generates a signal that is shifted by one counter from the data enable signal shown in (h) of FIG. 3, while counting 1 line period of the data enable signal of (g) of FIG. 3 using the horizontal counter, and then generates the line end flag Lef of (j) of FIG. 3 through a logical operation of the two signals. At this time, the value of the horizontal counter becomes a horizontal resolution (for example, the value can correspond to the value "640" of the horizontal counter in (i) of FIG. 3). The generated line end flag Lef is supplied to the vertical resolution detection circuit 25*v*. Furthermore, the value of the horizontal counter is reset according to the line end flag Lef. At this time, if the counter value of the horizontal counter reaches '2048', the horizontal resolution detection circuit 25*h* determines that the frame is ended and generates the frame end flag Fef shown in (c) of FIG. 3. The frame end flag Fef is supplied to the vertical resolution detection circuit 25*v* in the same manner as the line end flag Lef.

The vertical resolution detection circuit 25*v* counts the line end flag Lef received from the horizontal resolution detection circuit 25*h* by using the vertical counter of (k) of FIG. 3. The vertical resolution detection circuit 25*v* stops the counting of the line end flag Lef when the frame end flag Fef is received. The value of the vertical counter at that time becomes a vertical resolution (e.g., the value can correspond to the value "480" of the vertical counter in (d) of FIG. 3).

The horizontal resolution and the vertical resolution can be detected from the data enable signal de1*b* and the clock signal CLK2*b*, as described above. Even in the case where the data enable signal de1*a* and the clock signal CLK2*a* are used, a horizontal resolution and a vertical resolution can be obtained through this method. Furthermore, the method of detecting a horizontal resolution and a vertical resolution in the resolution detector 25 is not limited to the above method. It is to be understood that the horizontal resolution and the vertical resolution can be detected by other methods. The horizontal resolution and the vertical resolution detected by the resolution detector 25 are supplied to the enhanced parameter selector 26 as the resolution data k.

Method of Calculating Sampling Area

The enhanced parameter selector 26 generates parameter data for performing the setting of image correction in the automatic image correction circuit 100 by using the resolutions detected by the resolution detector 25.

Figures 4, 5:
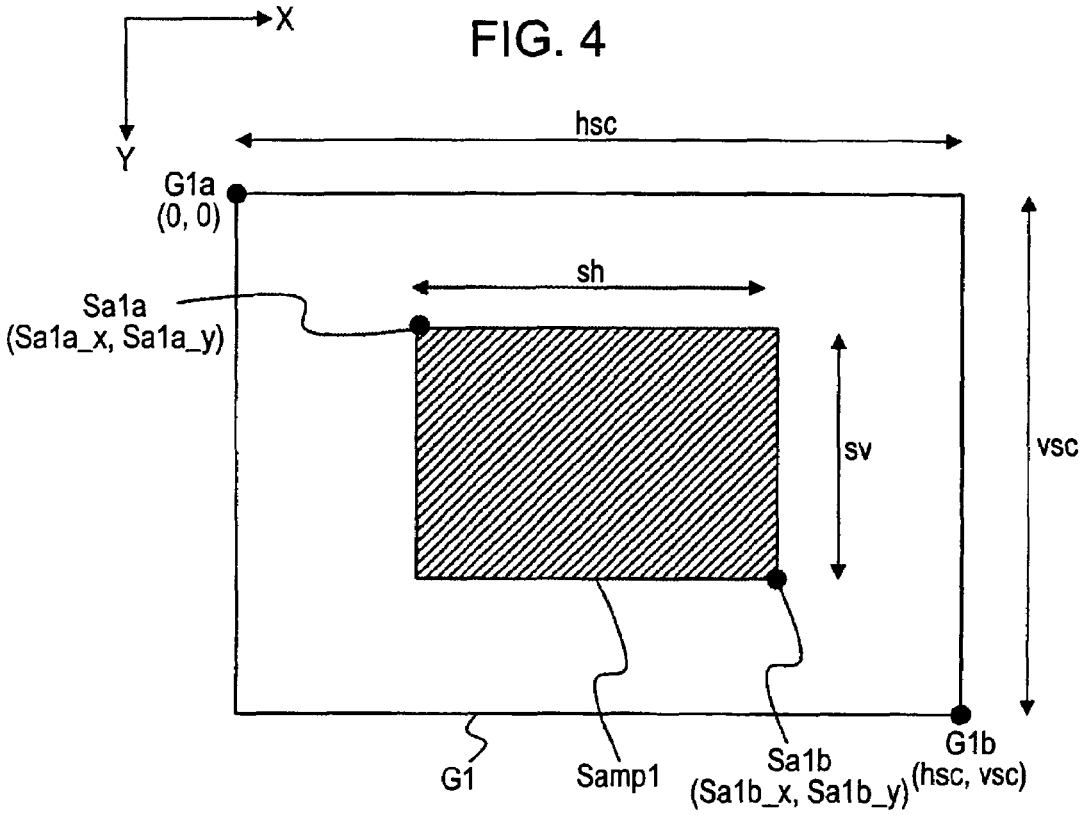
FIG. 4 is a view for illustrating a method of calculating a sampling area.
FIG. 5 is a table showing the relation between resolutions and the sizes of sampling areas.

A method of calculating a sampling area in the enhanced parameter selector 26 will be first described. FIG. 4 shows an example of a sampling area. In FIG. 4, a sampling area Samp1 indicates a central region of an image G1. As stated above, the sum total data calculation units 16*a* and 16*b* calculate a luminance sum total and a chroma sum total while generating a gray level value histogram, from the data of the sampling area.

In FIG. 4, the length hsc of the image G1 in a horizontal direction is a horizontal resolution and the length vsc of the image G1 in a vertical direction is a vertical resolution. To automatically calculate the position or size of the sampling area Samp1, it is necessary to know the horizontal resolution and the vertical resolution of the image G1. Therefore, the enhanced parameter selector 26 calculates a position or size of a sampling area in an image through the following method on the basis of the resolution data k received from the resolution detector 25, i.e., the horizontal resolution and the vertical resolution.

In FIG. 4, it is assumed that a point at the top left corner of the image G1 is a point G1*a* and a point at the bottom right corner, i.e., on a diagonal line of the point G1*a* is a point G1*b*. Assuming that a coordinate of the point G1*a* is a starting point, the axis pointing from the point G1*a* toward the right side of the image G1 in the horizontal direction is an X-axis, and the axis pointing from the point G1*a* toward the lower side of the image G1 in the vertical direction is a Y-axis. Assuming that the length of the image G1 in the horizontal direction is hsc and the length of the image G1 in the vertical direction is vsc, a coordinate of the point G1*b* at the bottom right corner of the image G1 is a point G1*b* (hsc, vsc). The position of the sampling area Samp1 can be found by deciding coordinates of two points on the diagonal line of the sampling area Samp1 on the image G1, e.g., a coordinate of each of a point Sa1*a* (Sa1*a*_*x*, Sa1*a*_*y*) and a point Sa1*b* (Sa1*b*_*x*, Sa1*b*_*y*) in FIG. 4. The method of calculating the sampling area will be described with reference to the example of FIG. 4.

In a first embodiment, the highest values of the powers of 2, which do not exceed the values of the horizontal resolution and the vertical resolution received from the resolution detector 25, respectively, are set to the length sh of the sampling area Samp1 in the horizontal direction and the length sv of the sampling area Samp1 in the vertical direction. When the highest values are converted to binary numbers, it is possible to detect only bits having a logic level 1, that is, bits set, and to reduce the size of the circuit. That is why the powers of 2 are used. Furthermore, the reason why the highest values are used is that a greater amount of data needs to be sampled in order to increase detection accuracy in each image.

The relation among the horizontal resolution hsc, the vertical resolution vsc, the length sh of the sampling area Samp1 in the horizontal direction, and the length sv of the sampling area Samp1 in the vertical direction is shown in FIG. 5. There is shown in FIG. 5 resolutions and the sizes of sampling areas. As described above, the length sh of the sampling area Samp1 in the horizontal direction, and the length sv of the sampling area Samp1 in the vertical direction are set to the highest values of the powers of 2, which do not exceed the values of the horizontal resolution hsc and the vertical resolution vsc, respectively. For example, assuming that the value of the horizontal resolution hsc is 640 dots and the value of the vertical resolution vsc is 480 dots, the length sh of the sampling area Samp1 in the horizontal direction is 512 dots, i.e., the highest value of the powers of 2, which does not exceed 640 dots. The length sv of the sampling area Samp1 in the vertical direction is 256 dots, i.e., the highest value of the powers of 2, which does not exceed 480 dots. By doing so, the length of the sampling area Samp1 in the horizontal direction and the length of the sampling area Samp1 in the vertical direction are decided based on the horizontal resolution and the vertical resolution. Practically, however, these values can be obtained by calculating the powers of 2 using a circuit and can also be found by maintaining a table indicating the relation between resolutions and the sizes of sampling areas in FIG. 5 and referring to the table from the resolutions received from the resolution detector 25.

FIG. 6 shows a detailed example. In this example, the lengths of sampling areas in horizontal directions and the lengths of the sampling areas in vertical directions are obtained with respect to the specifications of main resolutions through the above method. Furthermore, in FIG. 6, the term "sampling area ratio" indicates the ratio occupied by the sampling area, of the entire image. For example, in the case of SVGA specification, the value of the horizontal resolution hsc is 800 dots and the value of the vertical resolution vsc is 600 dots. At this time, the length sh of the sampling area in the horizontal direction is 512 dots and the length sv of the sampling area in the vertical direction is 512 dots. Therefore, the sampling area ratio is 512×512/800×600, i.e., 0.55. Furthermore, in the case of SVGA specification, the value of the horizontal resolution hsc can be 820 dots. Even in this case, the length sh of the sampling area in the horizontal direction can be decided as 512 dots and the length sv of the sampling area in the vertical direction can be decided as 512 dots, from the table that indicates the relation between the resolutions and the sizes of the sampling area in FIG. 5. As can be seen from FIG. 6, 40% or more of an image can be sampled though this method.

The position of the sampling area is then decided. In the first embodiment, the coordinates of the point Sa1*a* (Sa1*a*_*x*, Sa1*a*_*y*) and the point Sa1*b* (Sa1*b*_*x*, Sa1*b*_*y*), which are defined as two points on the diagonal line of the sampling area on the image G1 can be decided using the following equations.

$$Sa1a_x=(hsc-sh)/2 \quad (1)$$

$$Sa1a_y=(vsc-sv)/2 \quad (2)$$

$$Sa1b_x=Sa1a_x+sh \quad (3)$$

$$Sa1b_y=Sa1a_y+sv \quad (4)$$

Equations (1) to (4) are calculation equations for locating a sampling area at a central region of an image. In other words, the method of calculating the position of a sampling area is not limited to the above, but can include any calculation method of enabling a sampling area to be placed at a central region of an image.

Figure 7:
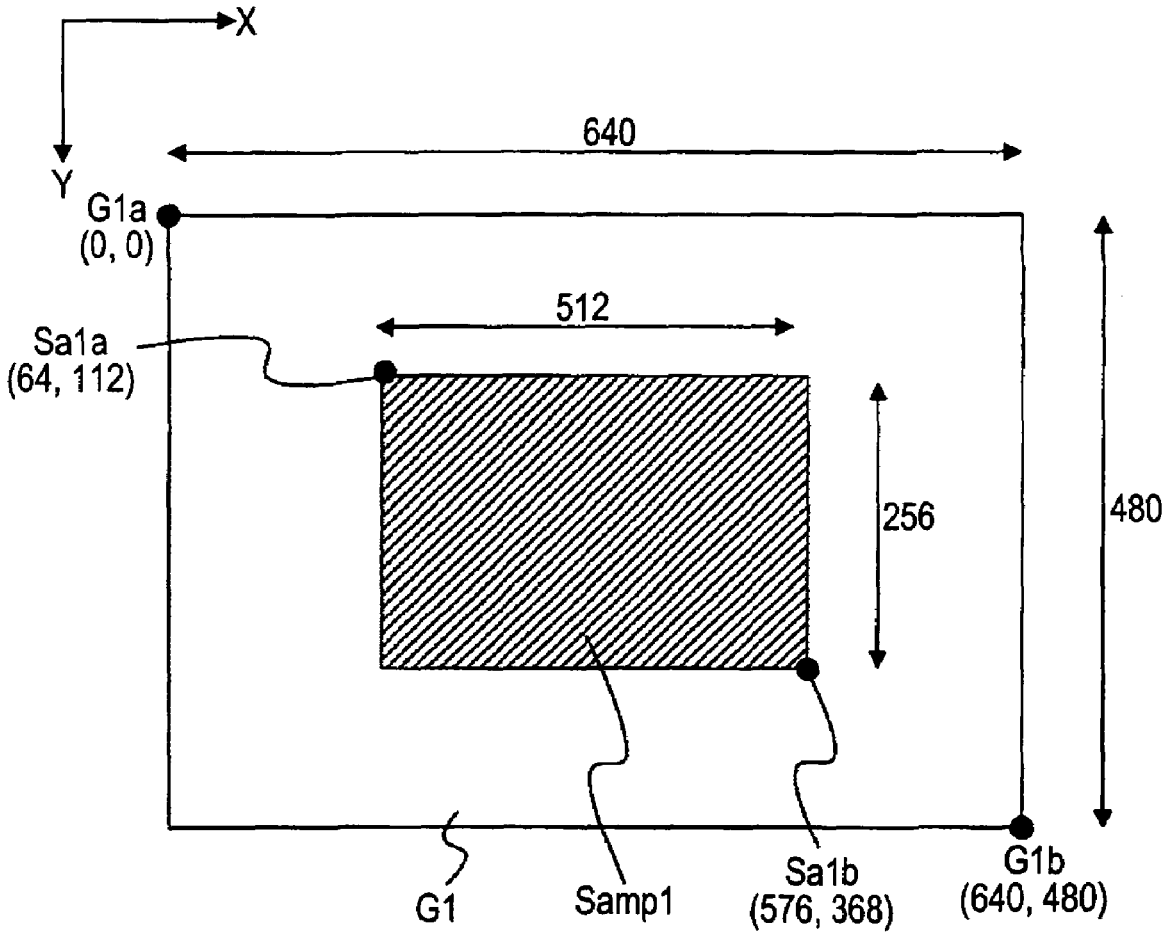
FIG. 7 is a view for illustrating a method of calculating a sampling area.

FIG. 7 shows, as a concrete example, the position of a sampling area, which is obtained by the above-mentioned calculation method when the resolutions of an image supplied from the resolution detector 25 correspond to VGA specification (the value of the horizontal resolution hsc is 640 and the value of the vertical resolution vsc is 480). In this case, the length sh of the sampling area in the horizontal direction is 512 and the length sv of the sampling area in the vertical direction is 256 according to the table indicating the relation between the resolutions and the sizes of the sampling area in FIG. 5. Therefore, the coordinates of two points that decide the sampling area in the image G1 can be decided as a point Sa1*a* (64, 112) and a point Sa1*b* (576, 368) in accordance with Equations (1) to (4).

Figure 8A:
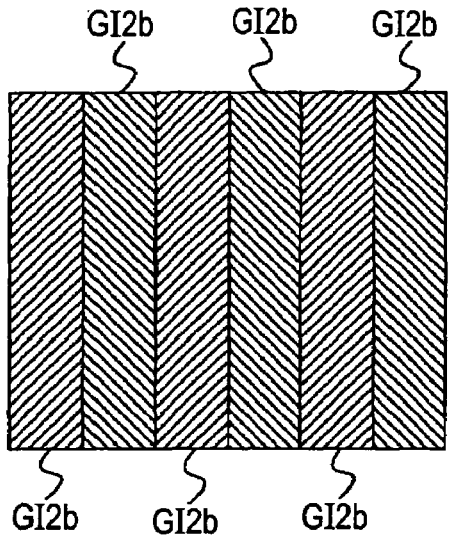
FIG. 8A is a view for illustrating a method of calculating a sampling area.

In the automatic image correction circuit 100 according to the first embodiment, the LVDS receiver 11 divides the image data d1 into two groups, and two blocks; the image correction block 50*a* and the image correction block 50*b* respectively perform an image correction process on the image data d2*a* and d2*b*, which are obtained by dividing the image data d1 into two groups. At this time, the LVDS receiver 11 divides the image data d1 into odd-numbered dot clocks and even-numbered dot clocks. FIG. 8A shows an example in which the LVDS receiver 11 divides the image data d1 into odd-numbered and even-numbered dot clocks. Image data GI2*a* corresponding to the even-numbered dot clock are input to the image correction block 50*a* and image data GI2*b* corresponding to the odd-numbered dot clock are input to the image correction block 50*b*.

Figure 8B:
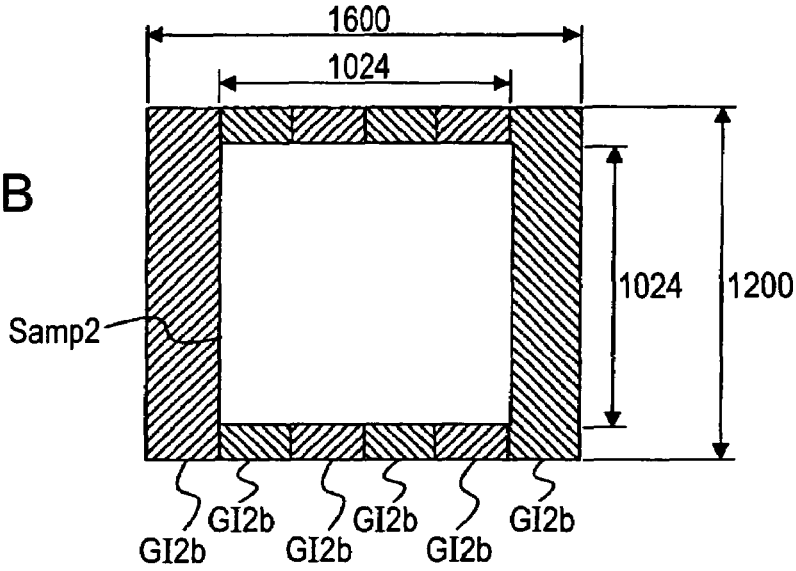
FIG. 8B is a view for illustrating a method of calculating a sampling area.
Figure 8C:
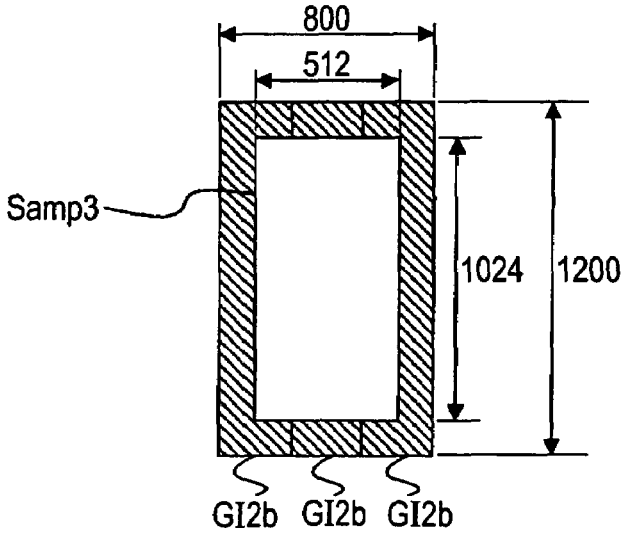
FIG. 8C is a view for illustrating a method of calculating a sampling area.

At this time, the resolution detector 25 is supplied with the data enable signal de1*b* and the clock signal CLK2*b* of the image data GI2*b* that are input to the image correction block 50*b*. Therefore, the image data GI2*b* become a valid sampling pixel. FIG. 8B shows a case where the resolutions of the image data d1 correspond to UXGA specification (the horizontal resolution is 1600 dots and the vertical resolution is 800 dots). FIG. 8C shows the image data GI2*b* obtained by dividing image data d1 of UXGA specification. In this case, although the horizontal resolution is 1600 dots, the image data are divided upon sampling. Therefore, the sampling is performed in the image data GI2*b* in which the horizontal resolution is 800 dots. In particular, the length of a horizontal direction is 1024 dots and the length of a vertical direction is 1024 dots in a sampling area Samp2 of the image data d1, as shown in FIG. 8B, whereas the length of a horizontal direction is 512 dots and the length of the vertical direction is 1024 dots in a sampling area Samp3 of the image data GI2*b*, as shown in FIG. 8C. Therefore, the automatic image correction circuit 100 can thin out sampling data by ½.

By finding the point Sa1*a* and the point Sa1*b* from the horizontal resolution hsc, the vertical resolution vsc, the length sh of the sampling area in the horizontal direction, and the length sv of the sampling area in the vertical direction, as described above, the position of the sampling area can be automatically decided. Information on the position of the sampling area obtained as described above is supplied to the sum total data calculation units 16*a* and 16*b* as the sampling area data Dsa_a and Dsa_b.

Method of Calculating Lightness Correction Coefficient

A method of calculating a lightness correction coefficient in the enhanced parameter selector 26 will now be described.

Figure 9A:
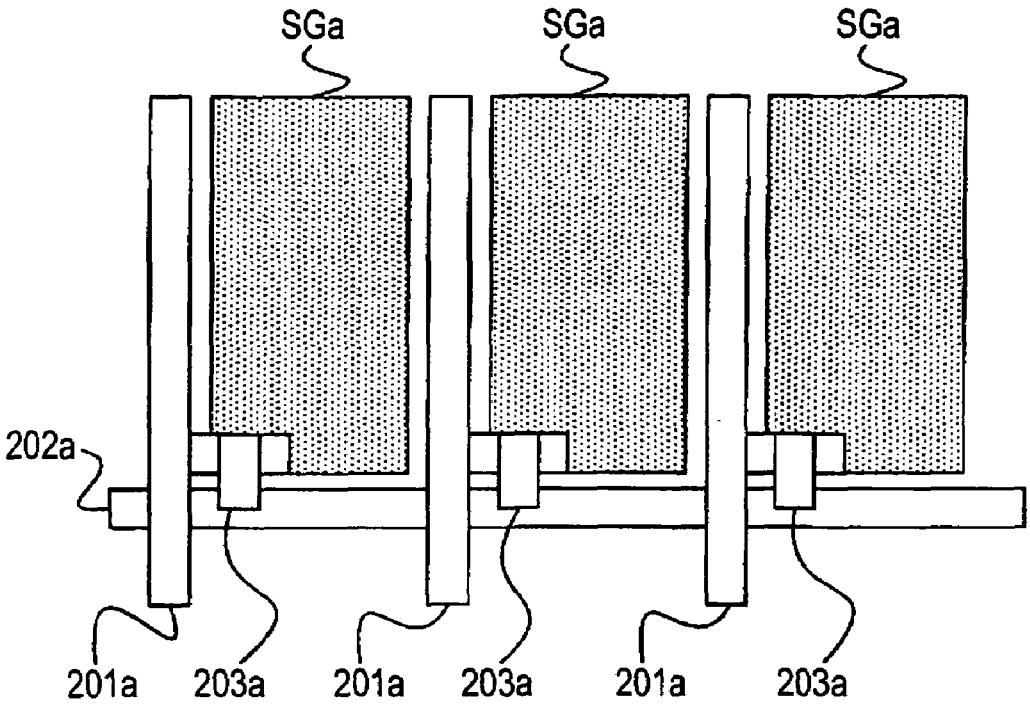
FIG. 9A is a view for illustrating a method of calculating an enhanced parameter.
Figure 9B:
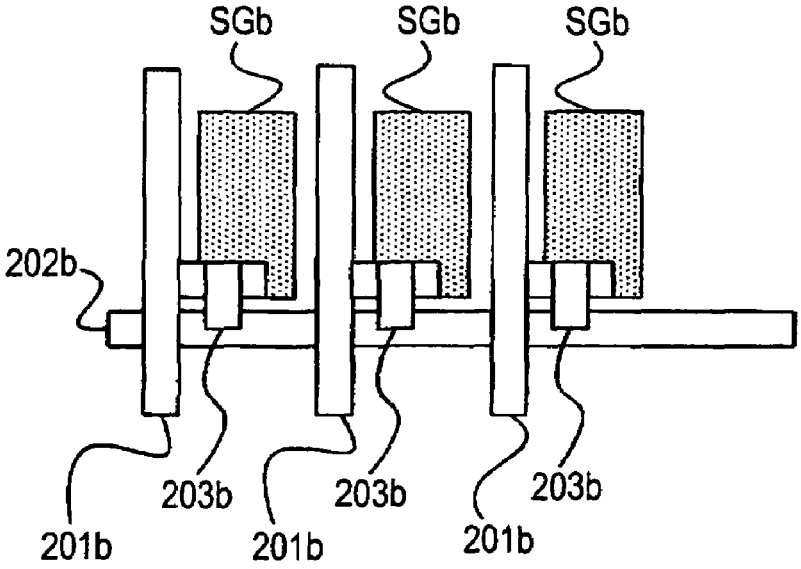
FIG. 9B is a view for illustrating a method of calculating an enhanced parameter.

FIGS. 9A and 9B show exemplary schematic diagrams of pixels of liquid crystal apparatuses. FIG. 9A shows the pixel of the liquid crystal apparatus with a low resolution and FIG. 9B shows the pixel of the liquid crystal apparatus with a high resolution. As shown in FIG. 9A, one pixel Sga of the liquid crystal apparatus includes a source line 201*a* that supplies a signal voltage to the pixel SGa in order to drive liquid crystal of a pixel SGa, a TFT element 203*a* that controls the current, which is supplied from the source line 201*a* to the pixel SGa, and a gate line 202*a* that supplies a control current to the TFT element 203*a*. In the liquid crystal apparatus with a high resolution, it is necessary to make small the area of the pixel SGa. However, the TFT element 203*a*, the source line 201*a*, and the gate line 202*a* cannot be made small at the same rate as the pixel SGa. This is because if these elements and circuit are made small at the same rate as the pixel SGa, electrical characteristics are deteriorated. Therefore, as shown in FIG. 9B, in the liquid crystal apparatus with a high resolution, the ratio occupied by the TFT element 203*b*, the source line 201*b*, and the gate line 202*b*, in the total area of the pixel SGb, becomes high. For this reason, in the liquid crystal apparatus with a high resolution, the aperture ratio of a pixel is lowered, which results in decreased brightness. In a display apparatus employing a TFT element board, such an organic EL apparatus, the aperture ratio is also lowered.

Therefore, in a first embodiment, an image correction operation for supplementing decreased brightness, which is incurred by the reduction in the aperture ratio of a pixel in an image with a high resolution, is performed. In particular, a coefficient, i.e., a lightness correction coefficient for supplementing such decrease in brightness using a horizontal resolution and a vertical resolution of image data, which are detected by the resolution detector 25, is calculated.

FIG. 10 is a table listing the resolutions of main specifications, which are detected by the resolution detector 25, aperture ratios at that time, and lightness correction coefficients suitable for supplementing a decrease in brightness. The table of resolutions and lightness correction coefficients shown in FIG. 10 is previously maintained in the enhanced parameter selector 26. The enhanced parameter selector 26 then selects an appropriate lightness correction coefficient from the table of the resolutions and the lightness correction coefficients of FIG. 10 based on a horizontal resolution and a vertical resolution of image data, which are detected by the resolution detector 25. In this case, as the aperture ratio becomes low, the lightness correction coefficient becomes high since it is necessary to increase the brightness of image data. For example, when the image data correspond to UXGA specification with a high resolution (a horizontal resolution is 1600 dots and a vertical resolution is 1200 dots), the aperture ratio drops to 60% since the ratio occupied by the above-mentioned elements and circuit is increased, as shown in FIG. 10. Therefore, an appropriate lightness correction coefficient for supplementing such decrease in brightness is 1.5.

The lightness correction coefficients calculated in the above-mentioned manner are supplied to the image correction units 19*a* and 19*b* as the set values Ds2*a* and Ds2*b*. However, the calculated lightness correction coefficients can be supplied to the image correction units 18*a* and 18*b* as the set values Ds1*a* and Ds1*b*. Therefore, the automatic image correction circuit 100 can automatically correct the brightness of an image according to the lightness correction coefficients, and can display an image at a proper brightness every resolution.

In the first embodiment, the automatic image correction circuit having two image correction blocks has been described. The invention is, however, not limited to the above embodiment. The resolution correction unit and the enhanced parameter selector can be assembled even in an automatic image correction circuit having one image correction block. Furthermore, in the first embodiment, a sampling area and a lightness correction coefficient have been described as enhanced parameters. The invention is, however, not limited to the above example. A user can decide enhanced parameters, such as other image correction coefficients using detected resolutions of image data.

Second Embodiment

In a second embodiment, the above-described resolution detector is further provided outside the automatic image correction circuit 100 according to the first embodiment so that images can be automatically enlarged or reduced.

Figure 11:
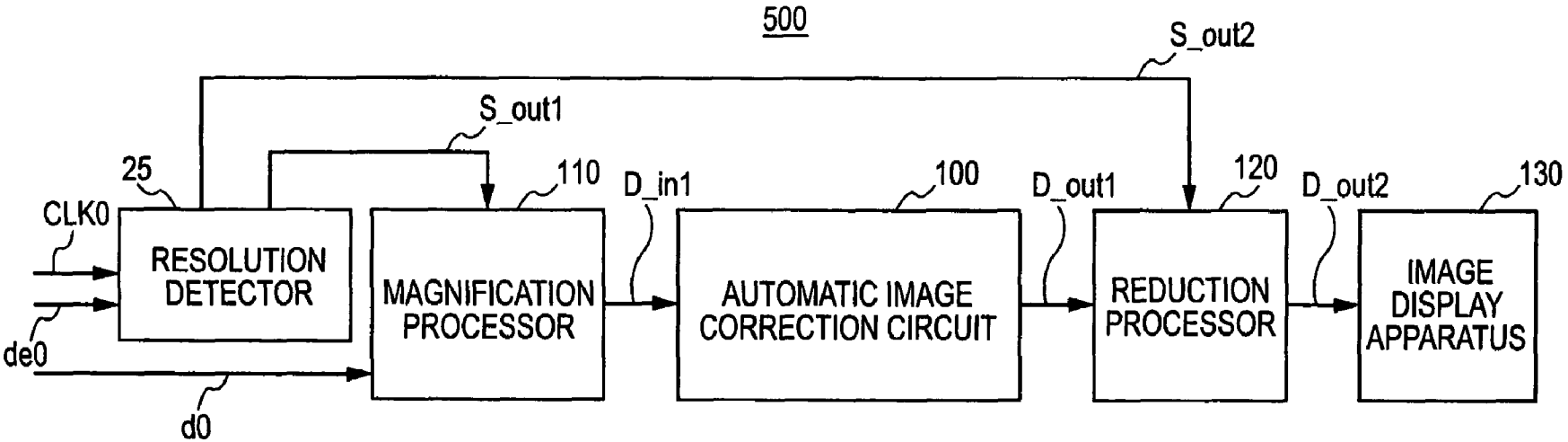
FIG. 11 schematically shows the construction of an automatic image correction circuit according to a second embodiment of the invention.

FIG. 11 is a block diagram of an automatic image correction circuit 500 according to a second embodiment of the invention.

The automatic image correction circuit 500 includes the automatic image correction circuit 100 according to the first embodiment, an image magnification processor 110 that enlarges an image, an image reduction processor 120 that reduces an image, an image display device 130, and a resolution detector 25.

The input side of the automatic image correction circuit 100 is connected to the image magnification processor 110. The output side of the automatic image correction circuit 100 is connected to the image reduction processor 120.

The image display device 130 is connected to the image reduction processor 120. The resolution detector 25 is connected to the image magnification processor 110 and the image reduction processor 120.

The resolution detector 25 detects the horizontal resolution and the vertical resolution of received image data d0 from a clock signal CLK0 and a data enable signal de0 of the received image data d0. The resolution detector 25 has the display resolution of the image display unit 130 previously stored therein. If the resolutions are smaller than the display resolution, the resolution detector 25 supplies a control signal S_out1 to the image magnification processor 110 so that the magnification process can be performed. If the resolutions are greater than the display resolution of the image display unit 130, the resolution detector 25 supplies a control signal S_out2 to the image reduction processor 120 so that the reduction process can be performed.

If the control signal S_out1 is received from the resolution detector 25, the image magnification processor 110 performs the image magnification process on the received image data d0 and supplies the processed result to the automatic image correction circuit 100 as image data D_in1.

If the control signal S_out2 is received from the resolution detector 25, the image reduction processor 120 performs the image reduction process on the image data D_out1 received from the automatic image correction circuit 100 and outputs the processed result to the image display apparatus 130 as image data D_out2.

In the case where image data are enlarged or reduced by using the automatic image correction circuit 500, the automatic image correction circuit 100 performs an enhancement process on the image data after the magnification process or before the reduction process. This is because, in the case of the image magnification process, it is appropriate to perform the enhancement process after information of original image data is enlarged. Meanwhile, this is because, in the case of the image reduction process, it is appropriate to perform the reduction process on the image data after the enhancement process is performed. For this reason, in the automatic image correction circuit 500 according to the second embodiment, the image magnification processor 110 is connected to the input side of the automatic image correction circuit 100 and the image reduction processor 120 is connected to the output side of the automatic image correction circuit 100.

The method of enlarging or reducing image data in the image magnification processor 110 or the image reduction processor 120 will be described below in detail. In the case where the magnification process or the reduction process is performed on received image data, image data after the process need to be found by interpolation from image data of a lattice point around the received image data on the received image data. Hereinafter, three kinds of methods including the nearest neighbor interpolation method, the bi-linear interpolation method and the cubic convolution interpolation method will be described as several examples of the method of finding image data after conversion.

It is assumed that coordinates of image data after conversion, i.e., coordinates of points of a pixel to be interpolated are (u, v) and image data after conversion is P. It is also assumed that pixels of image data before conversion are sequentially numbered in order of a X direction and a Y direction, the number of the X direction is i, the number of the Y direction is j, and the positions of the pixels at these points are indicated by Pij.

Figure 12A:
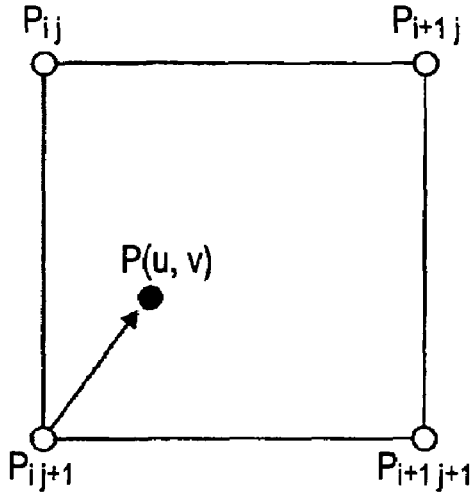
FIG. 12A is a view for illustrating a method of a magnification/reduction process.

FIG. 12A schematically shows a case where the nearest neighbor interpolation method is applied. As shown in FIG. 12A, in the nearest neighbor interpolation method, image data that are the nearest to a point to be interpolated are decided as image data after conversion. For instance, in this method, information of one pixel of pixel data is allocated to four pixels without change and the allocated information are then represented as information of the pixels after magnification. This can be expressed in the following Equations (5) to (7).

$$P=P_{ij} \tag{5}$$

$$i=[u+0.5] \tag{6}$$

$$j=[v+0.5] \tag{7}$$

This method is advantageous in that input image data can be kept intact and an algorithm can be simplified although error of a maximum ½ pixel occurs.

Figure 12B:
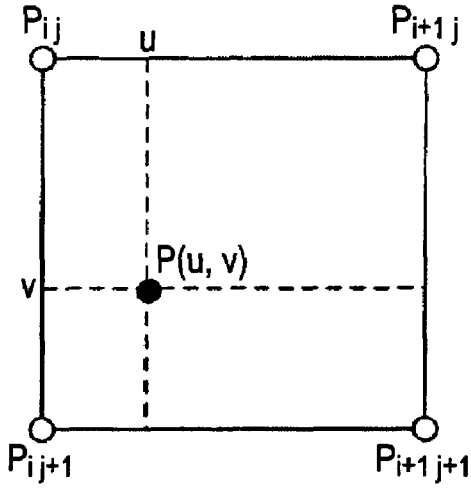
FIG. 12B is a view for illustrating another method of a magnification/reduction process.

FIG. 12B schematically shows a case where the bi-linear interpolation method is applied. As shown in FIG. 12B, in the bi-linear interpolation method, interpolation is carried out using image data of four points around a point to be interpolated in accordance with Equations (8) to (10).

$$P = \{(i+1)-u\}\{(j+1)-v\}P_{ij} + \{(i+1)-u\}\{v-j\}P_{ij+1} + (u-i)\{(j+1)-v\}P_{i+1j} + (u-i)(v-j)P_{i+1\,j+1} \tag{8}$$

$$i = [u] \tag{9}$$

$$j = [v] \tag{10}$$

This method is advantageous in that an image can be smoothed because of averaging.

Figure 12C:
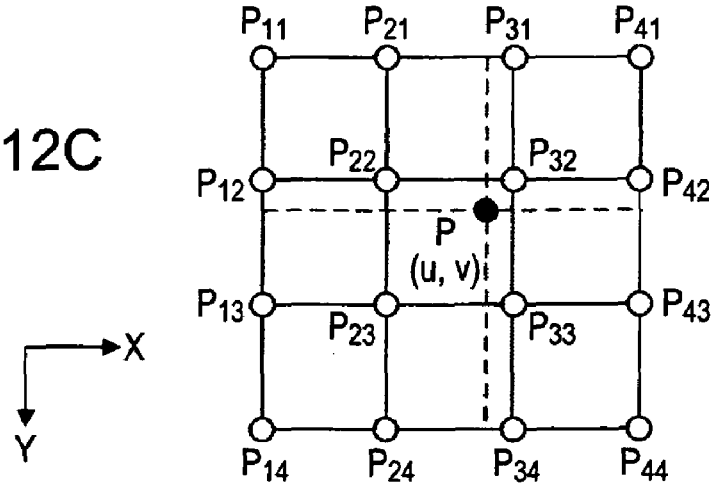
FIG. 12C is a view for illustrating another method of a magnification/reduction process.

FIG. 12C schematically shows a case where the cubic convolution interpolation method is applied. As shown in FIG. 12C, in the cubic convolution interpolation method, interpolation is performed using image data of 16 points around a point to be interpolated. In this method, after image data of the point to be interpolated are found, images data of the four points, which are the nearest to the point to be interpolated, of the image data of the 16 points, are more weighted than image data of 12 points that surround the image data of the four points. This can be expressed in the following Equations (11) to (13).

$$P = [f(y_1)\ f(y_2)\ f(y_3)\ f(y_4)] \begin{bmatrix} P_{11} & P_{12} & P_{13} & P_{14} \\ P_{21} & P_{22} & P_{23} & P_{24} \\ P_{31} & P_{32} & P_{33} & P_{34} \\ P_{41} & P_{42} & P_{43} & P_{44} \end{bmatrix} \begin{bmatrix} f(x_1) \\ f(x_2) \\ f(x_3) \\ f(x_4) \end{bmatrix} \tag{11}$$

$$f(t) = \sin(\pi t)/(\pi t) \approx \begin{cases} 1 - 2|t|^2 + |t|^3 \\ 4 - 8|t| + 5|t|^2 - |t|^3 \\ 0 \end{cases} \tag{12}$$

$$\begin{cases} x_1 = 1 + (u - [u]) & y_1 = 1 + (v - [v]) \\ x_2 = (u - [u]) & y_2 = (v - [v]) \\ x_3 = 1 - (u - [u]) & y_3 = 1 - (v - [v]) \\ x_4 = 2 - (u - [u]) & y_4 = 2 - (v - [v]) \end{cases} \tag{13}$$

This method is advantageous in that an image can be smoothed and sharpened.

The image magnification processor 110 or the image reduction processor 120 uses the above-described method and can thus obtain image data after magnification conversion or reduction conversion from input image data. The invention is, however, not limited to the above method, but can include other methods capable of finding image data after magnification conversion or reduction conversion.

Figure 13:
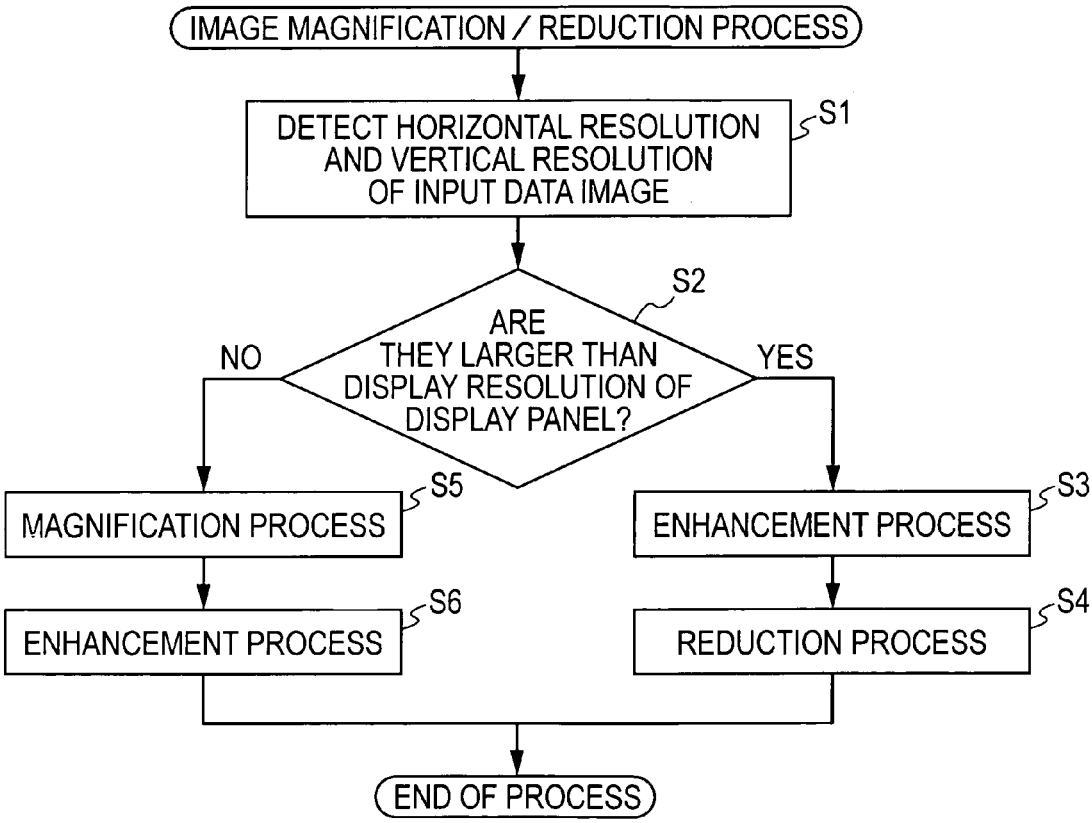
FIG. 13 is a flowchart for illustrating a method of an image magnification/reduction process.

The image magnification/reduction processes will be described below with reference to the flowchart of FIG. 13. The resolution detector 25 detects a horizontal resolution and a vertical resolution of the image data d0 from a clock signal CLK0 and the data enable signal de0 of the image data d0, which are input to the automatic image correction circuit 500 (step S1). The resolution detector 25 determines whether the detected resolutions are greater than a display resolution of the image display unit 130 (step S2). If it is determined that the detected resolutions are greater than the display resolution of the image display unit 130 (step S2: Yes), the resolution detector 25 supplies the control signal S_out2 to the image reduction processor 120 so that the image reduction process can be performed. On the other hand, the image magnification processor 110 outputs the image data d0 as the image data D_in1 without performing any process. Thereafter, the image data D_in1 are input to the automatic image correction circuit 100 and then undergo the enhancement process (step S3). The image reduction processor 120 receives the image data D_out1, which have experienced the enhancement process through the image correction circuit 100, performs the image reduction process on the received image data D_out1 and outputs the processed result to the image display device as the image data D_out2 (step S4).

Meanwhile, if it is determined that the detected resolutions of the image data d0 are smaller than the display resolution of the image display unit 130 (step S2: No), the resolution detector 25 supplies the control signal S_out1 to the image magnification processor 110 so that the magnification process can be performed. The image magnification processor 110 performs the magnification process on the image data d0 and outputs the processed result to the image correction circuit 100 as the image data D_in1 (step S5). Thereafter, the image data D_in1 are input to the image correction circuit 100 and then undergo the enhancement process (step S6). The image reduction processor 120 receives the image data D_out1, which have experienced the enhancement process, from the image correction circuit 100, and then outputs the image data D_out1 to the image display apparatus 130 as the image data D_out2 without performing any process. As described above, the resolutions of the image data are detected, and the detected resolutions are compared with the resolution of the display panel. It is thus possible to automatically decide which one of the magnification process and the reduction process will be performed.

Electronic Apparatus

Figure 14:
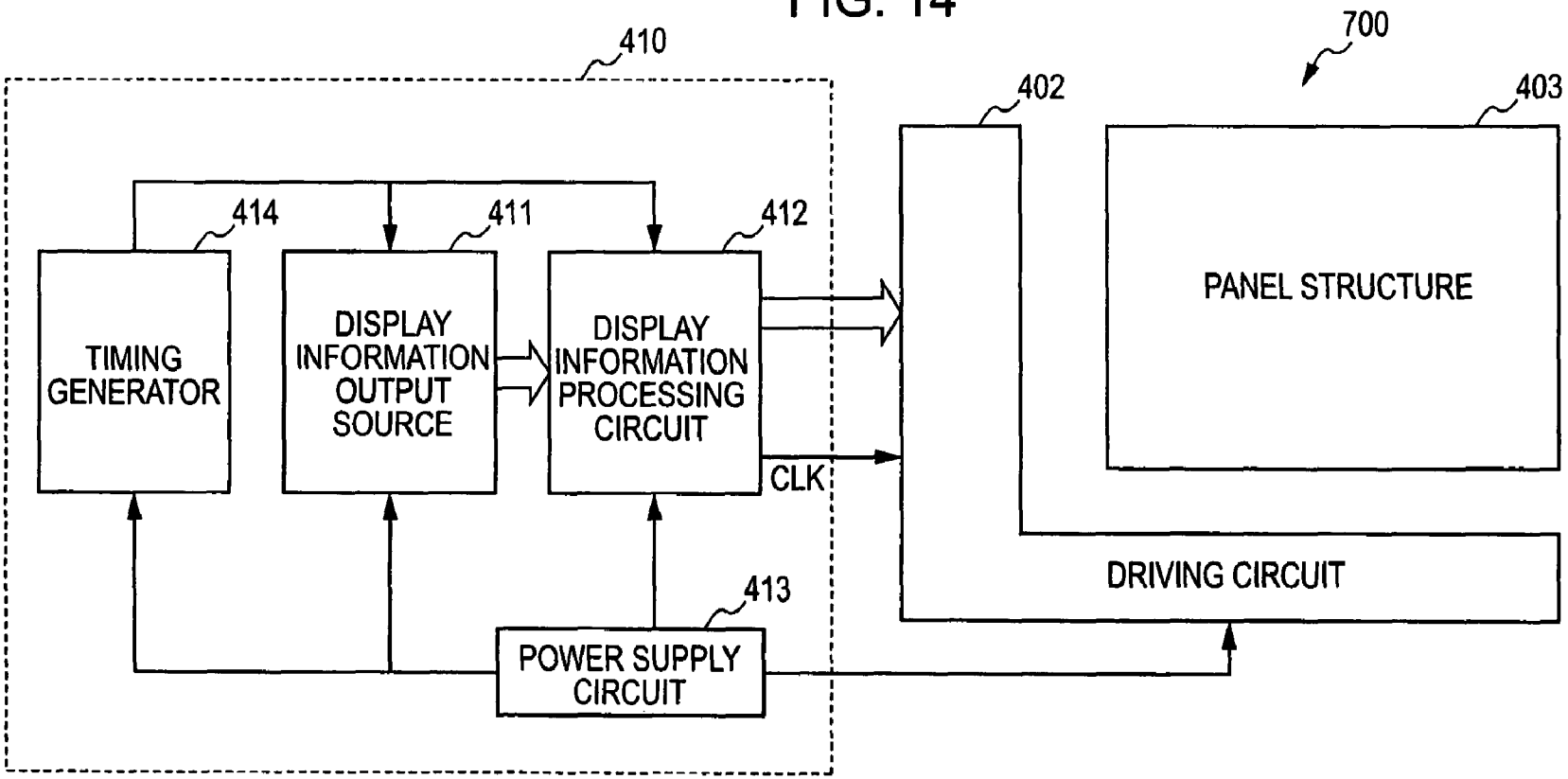
FIG. 14 is a circuit block diagram of an electronic apparatus to which the automatic image correction circuit of the invention is applied.

Hereinafter, an example of an electronic apparatus to which the automatic image correction circuit 100 or 500 of the invention is applied will be described. FIG. 14 schematically shows an overall construction of an electronic apparatus to which the invention is applied. The electronic apparatus shown in FIG. 14 includes a liquid crystal display apparatus 700 as an image display unit, and a control unit 410 that controls the liquid crystal display apparatus 700. In this case, the liquid crystal display apparatus 700 is shown with it being conceptually divided into a panel structure 403 and a driving circuit 402 comprised of a semiconductor IC, etc. The automatic image correction circuit 100 or 500 of the invention can be disposed within the driving circuit 402. The control unit 410 includes a display information output source 411, a display information processing circuit 412, a power supply circuit 413, and a timing generator 414.

The display information output source 411 includes a memory such as Read Only Memory (ROM) or Random Access Memory (RAM), a storage unit such as a magnetic recording disk or an optical recording disk, and a tuning circuit that outputs a digital image signal in a synchronous manner. The display information output source 411 is constructed to supply display information, such as an image signal of a predetermined format, to the display information processing circuit 412 according to various clock signals generated by the timing generator 414.

The display information processing circuit 412 includes a variety of known circuits, such as a serial/parallel conversion circuit, an amplification/inversion circuit, a rotation circuit, a gamma correction circuit, and a clamp circuit. The display information processing circuit 412 processes received display information, and supplies the processed image information to the driving circuit 402 along with a clock signal CLK. The driving circuit 402 includes a scanning line driving circuit, a data line driving circuit, and a test circuit. Furthermore, the power supply circuit 413 supplies a predetermined voltage to each of the above-mentioned elements.

Figure 15A:
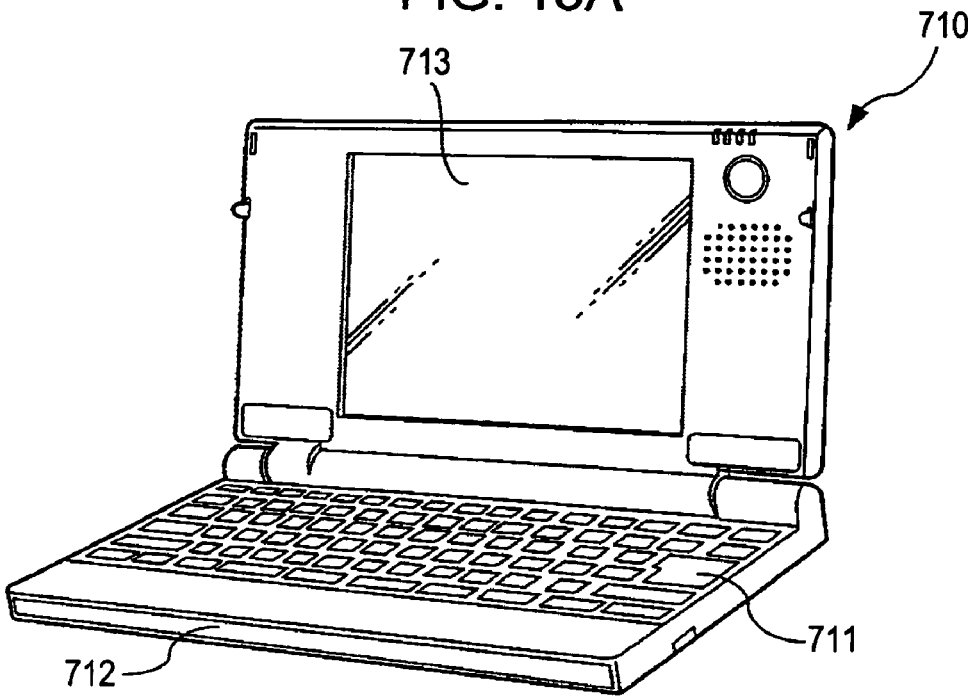
FIG. 15A shows an example of an electronic apparatus to which the automatic image correction circuit of the invention is applied.
Figure 15B:
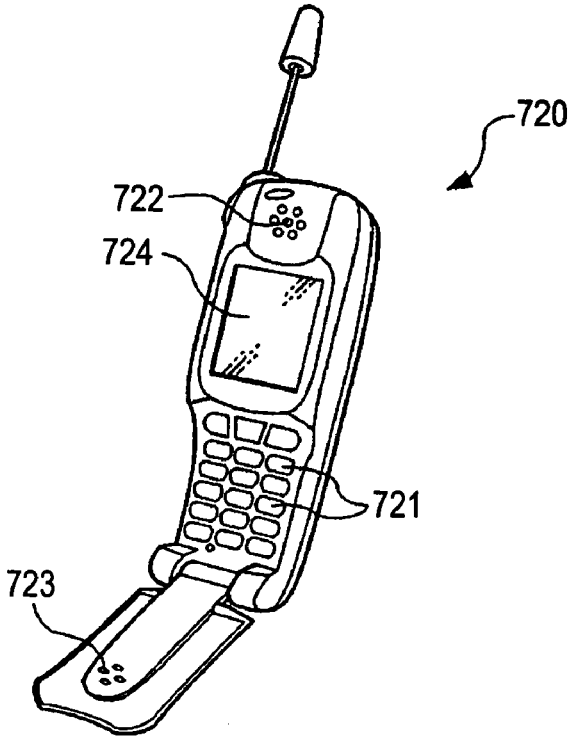
FIG. 15B shows another example of the electronic apparatus to which the automatic image correction circuit of the invention is applied.

Concrete examples of the electronic apparatus to which the invention is applied will be described with reference to FIGS. 15A to 15B.

An example in which the automatic image correction circuit 100 or 500 according to the invention is applied to a portable personal computer (so-called a notebook computer) will be described. FIG. 15A is a perspective view illustrating the construction of the personal computer. As shown in FIG. 15A, the personal computer 710 includes a main body 712 having a keyboard 711, and a display unit 713 to which a liquid crystal display panel according to the invention is applied.

An example in which the automatic image correction circuit 100 or 500 according to the invention is applied to a portable telephone will be described below. FIG. 15B is a perspective view illustrating the construction of the portable telephone. As shown in FIG. 15B, the portable telephone 720 includes a plurality of manipulation buttons 721, an earpiece 722, a mouthpiece 723, and a display unit 724 using a liquid crystal apparatus according to the invention.

Furthermore, electronic apparatuses to which the automatic image correction circuit 100 according to the invention can be applied may include a liquid crystal television, a video phone, and so on.

What is claimed is:

1. An automatic image correction circuit that performs image correction on received image data, comprising:

a resolution detection unit that detects resolutions of the image data;

a set value calculation unit that calculates a set value of a position of a sampling area, which is all or a portion of the image data, to be used in the image correction based on the resolutions;

a sum total data calculation unit calculating a sum total data including at least one of a luminance sum total and a chroma sum total from data of the sampling area; and an image correction unit that performs the image correction on the image data based on the sum total data and the set value, the set value calculation unit setting lengths of the sampling area in a horizontal and a vertical direction, respectively, to maximum values of the powers of 2 which do not exceed values of horizontal resolution and vertical resolution received from the resolution detection unit.

2. The automatic image correction circuit according to claim 1, the set value calculation unit calculating the position of the sampling area on a basis of a horizontal resolution and a vertical resolution, so that the sampling area is located at a central region of an image.

3. The automatic image correction circuit according to claim 1, the set value calculation unit setting a range of the sampling area to a value that is a power of 2.

4. The automatic image correction circuit according to claim 1, the set value calculation unit calculating a lightness correction coefficient based on a horizontal resolution and a vertical resolution of the image data in a set value for correcting a brightness of the image data.

5. The automatic image correction circuit according to claim 1, further comprising:

a storage unit that stores a resolution of a display panel;

a resolution comparison unit that compares the resolution of the display panel and the resolutions of the image data;

an image magnification process unit that magnifies the image data; an image reduction process unit that reduces the image data; and the image correction unit performing image correction on image data that are obtained by reducing the image data by the image reduction process unit when the resolution of the display panel is smaller than the resolutions of the image data, and performing image correction on image data that are enlarged by the image magnification process unit when the resolution of the display panel is larger than the resolutions of the image data.

6. An electronic apparatus, comprising:

the automatic image correction circuit according to claim 1; and an image display unit that displays image data on which image correction is performed by the automatic image correction circuit.

* * * * *